US005806744A

United States Patent [19]

Paoletti et al.

[11] Patent Number: 5,806,744

[45] Date of Patent: Sep. 15, 1998

[54] APPARATUS FOR FEEDING AND TENSIONING THREADS IN A TEXTILE MACHINE

[75] Inventors: Stefano Paoletti; Leonardo Leni, both of Quarrata, Italy

[73] Assignee: Vogue S.R.L., Florence, Italy

[21] Appl. No.: 622,578

[22] Filed: Mar. 25, 1996

[30] Foreign Application Priority Data

Mar. 27, 1995 [IT] Italy ..... FI95A0057

[51] Int. Cl.[6] ..... B23Q 15/12

[52] U.S. Cl. ..... 226/37; 226/44; 226/155; 242/418.1

[58] Field of Search ..... 226/25, 37, 44, 226/195, 152, 155, 187; 242/418.1, 151; 139/194, 450

[56] References Cited

U.S. PATENT DOCUMENTS

| | | | |
|---|---|---|---|
| 369,710 | 9/1887 | Hill | 242/151 |
| 2,089,620 | 8/1937 | Rossmann | 139/194 |
| 2,407,773 | 9/1946 | Fletcher | 139/194 |
| 2,499,699 | 3/1950 | Tinkham | 226/155 X |
| 2,943,852 | 7/1960 | Quirk | 226/195 X |
| 3,297,223 | 1/1967 | Bueker | 226/187 X |
| 3,343,738 | 9/1967 | Lawson | 226/44 X |

FOREIGN PATENT DOCUMENTS

| | | | |
|---|---|---|---|
| 2352906 | 12/1977 | France | 139/450 |
| 449957 | 10/1927 | Germany | 242/418.1 |
| 2406581 | 9/1974 | Germany | 226/44 |
| 1670007 | 8/1991 | U.S.S.R. | 139/450 |

*Primary Examiner*—Daniel P. Stodola
*Assistant Examiner*—Gregory J. Strimbu
*Attorney, Agent, or Firm*—McGlew and Tuttle

[57] ABSTRACT

Apparatus for feeding and tensioning threads in a textile machine including corresponding weaving members supplied with the threads. For each thread, a calander is provided with first and second superimposed wheels between which the thread, coming from a corresponding store located upstream of the apparatus, is made to pass. The wheels are mounted on corresponding parallel, horizontal shafts. A body for supporting the wheels is rotatively mounted on a corresponding body shaft having axis parallel to one of the wheels. The body itself is supported by a fixed bearing structure. A thread-holder arm of flexible and elastic material is provided with one end fixed to the body and the other end of the arm is provided with a thread-guiding ring through which the thread, coming from the calander (H), is made to pass. The arm is located above the weaving device of the machine in order to drive the body into rotation about the corresponding body shaft when the pull exerted on the thread by the weaving device is greater than a predetermined value.

6 Claims, 5 Drawing Sheets

APPARATUS FOR FEEDING AND TENSIONING THREADS IN A TEXTILE MACHINE

FIELD OF THE INVENTION

The present invention refers to an apparatus for feeding and tensioning the threads of a textile machine.

BACKGROUND OF THE INVENTION

It is known that in conventional textile machines the threads fed to the weaving members are taken out from a corresponding store which may comprise, for example, a plurality of bobbins of threads located on one or more creels, and driven towards the proper weaving members, such as a front of needles, by the pull exerted thereon by the latter during the weaving operation.

However, the thread-feeding technique exhibits some drawbacks. The threads are not uniformly tensioned throughout the feed path, especially over the length which is closer to the weaving members. This is because the latter do not exert the same pull on all the threads, due to their being differentially operated in relation to the structure and pattern of the product under formation, and because they act on threads which may follow paths of different length and are subject to different friction on the respective thread-guiding means. This is also due to the different nature and dimension of the same threads. This problem is even more critical in those cases where the threads store is located quite far away from the weaving member. The different tensioning of the threads is cause for permanent defects in the product under formation. These defects are often quite evident and visible to the naked eye, such as in case of fabrics obtained from threads of very small diameter. Moreover, the weaving members are caused to exert an excessive tensile stress on the threads, which reduces the work speed and thus the production.

SUMMARY AND OBJECTS OF THE INVENTION

The main object of the present invention is to overcome the drawbacks.

This result has been achieved, according to the invention, by adopting the idea of making an apparatus having a body which is rotatable about a body axis. First and second wheels are rotatably positioned in the body and are positionable on opposite sides of the thread. The first and second wheels have respective axes of rotation which are parallel to each other and parallel to the body axis. A thread-holder arm has a first end fixed to the body and a second end extending away from the body, where the second end has a thread-guiding ring. The second end of the thread-holder arm is positioned with respect to the body axis and with respect to the textile machine to cause rotation of the body about the body axis when a tension of the thread from the textile machine is greater than a predetermined value. An acceleration means, which is usually a roller with a frictional engaging surface is positioned so that the frictional surface engages with the surface of one of the wheels when the body is rotated due to the tension of the thread from the textile machine.

The advantages deriving from the present invention lie essentially in that it is possible to ensure the feeding and correct tensioning of all the thread supplied to the weaving members of a textile machine; that it is possible to increase the work speed and thus the production of a textile machine provided with such apparatus; that the quality of the finished product is increased; that an apparatus according to the invention is of reduced dimensions, easy to construct, cost-effective, reliable even after a prolonged life service, and simply applicable also to known current machines.

These and other advantages and characteristics of the invention will be best understood by anyone skilled in the art from a reading of the following description in conjunction with the attached drawings given as a practical exemplification of the invention, but not to be considered in a limitative sense, wherein:

DETAILED DESCRIPTION OF THE PREFERRED EMBODIMENTS

Figure 1:
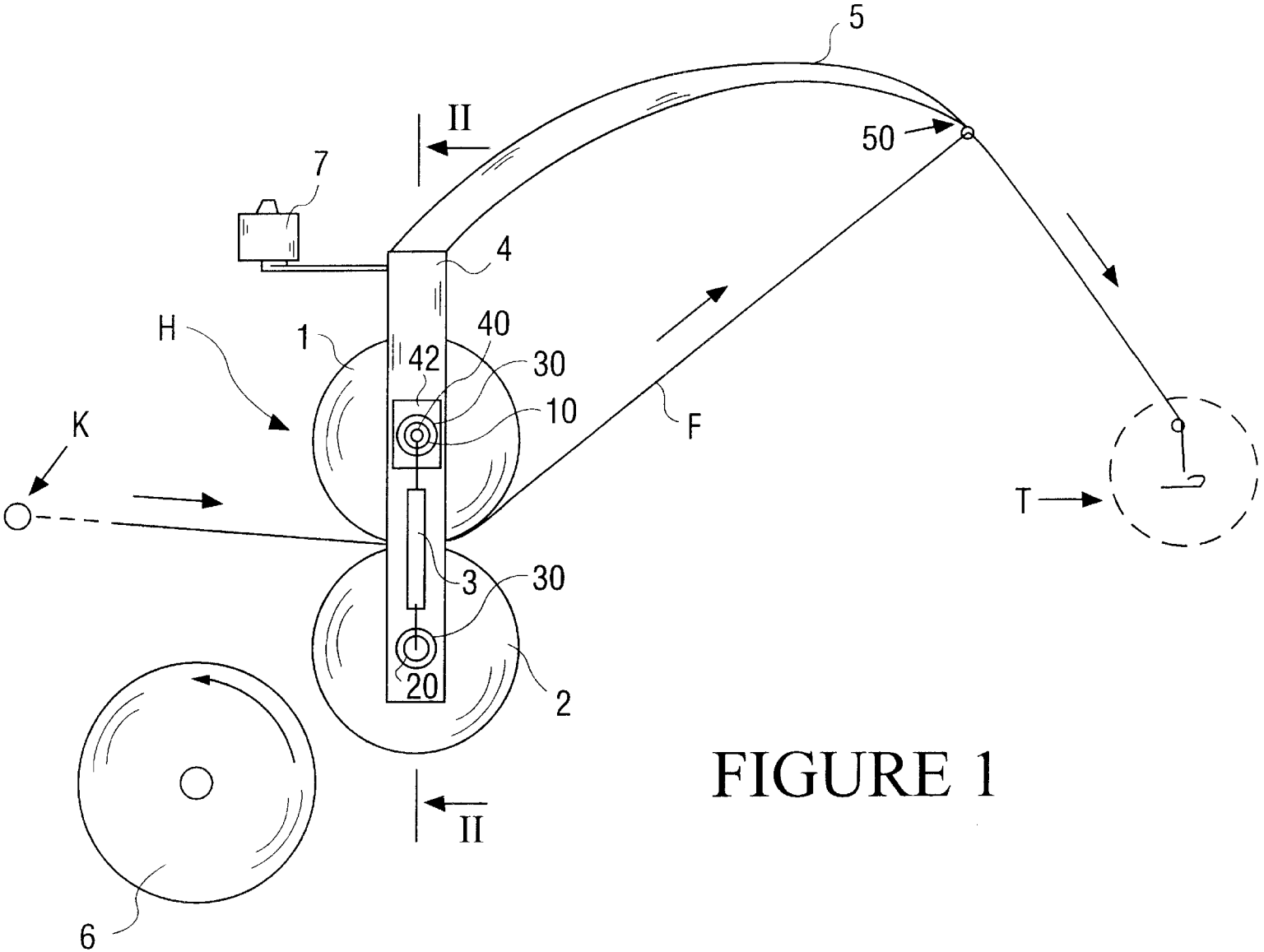
FIG. 1 shows schematically the side view of an apparatus according to the invention under inoperative condition.

Reduced to its basic structure, and reference being made to the figures of the attached drawings, an apparatus for feeding and tensioning threads in a textile machine according to the invention comprises in combination:

for each thread (F), a calander (H) with first and second superimposed wheels 1, 2 between which the thread (F), coming from a corresponding store (K) located upstream of the apparatus, is made to pass: the wheels 1, 2 being mounted on corresponding parallel, horizontal shafts 10, 20;

a body 4 rotatively mounted on a corresponding body shaft 40 coaxial to the shaft 10 of the upper or first wheel 1, with a cavity 41 within which the wheels 1, 2 are housed so that the lower wheel 2 will be positioned partially external and past the cavity 41, the body defines two side slotted holes 42 opposite to each other through which the respective shaft 40 is made to pass: the shaft 10 of the upper or first wheel 1 being idly fitted on the shaft 40, and the shaft 40 of the body 4 being fitted within corresponding seats of a bearing, spatially fixed structure or support 9;

a thread-holder arm 5 of flexible and elastic material has one end which is fixed to the body 4 and another end of the arm 5 is provided with a thread-guiding ring 50 through which the thread, coming from the calander (H), is made to pass, the arm 5 being located above the weaving means (T) of the machine (FIG. 1 showing schematically a needle being fed with the thread), the other end being oriented towards the weaving means;

a roller 6 rotating about a corresponding horizontal axis (m—m) parallel to the axis of the shafts 10, 20, the roller 6 is located rearwardly of the lower wheel 2 at a predetermined distance therefrom, so as to result in contact therewith when a rotation of a predetermined angle of body 4 about a respective body axis (s—s) takes place.

It will be appreciated that the roller 6 is properly operated by suitable driving means, such as an electric motor, not shown in the figures of the drawings for sake of clarity.

Advantageously, according to the invention, the present apparatus comprises elastic means 3 which operate the connection of shafts 10, 20 of the wheels 1, 2 and acting in a direction orthogonal to the respective axis of rotation. In this way, a steady adherence of the corresponding surfaces of the two wheels 1, 2 is ensured whatever the diameter and type of the thread (F) interposed therebetween. The vertical movement of the body 4, along with wheel 2, is allowed by the presence of the slotted holes 42, whose height is suitably greater than the diameter of shafts 10 and 40.

Advantageously, according to the invention, the elastic means 3 consist of two spiral springs located on opposite sides of the body 4. The springs are engageable to corresponding bushings or sleeves 30 fitted on the shafts 10, 20. Alternatively, the springs are directly engageable to the shafts 10, 20 for the support of wheels 1, 2, the latter being idly mounted on the shafts.

It will be appreciated that, in place of the springs, other suitable elastic means may be provided, such as rings made of rubber or artificial plastic material and fitted astride on the shafts 10 and 20.

The arm 5 may be made, for example, of music wire steel as well as of artificial plastic material having a predetermined modulus of elasticity.

It will be appreciated that several apparatus of the above type may be located side-by-side to operate the tensioning of a plurality of corresponding threads (F) of a textile machine, which are either of same or different types and may be fed at same or different speeds. Preferably, only one roller 6 is provided for all the calanders (H), which rotates at a speed corresponding to that of maximum output of thread (F). Stacks or surpluses of thread, if any, downstream of the calander, resulting from a difference between the feeding speed of the thread and the speed actually required by the weaving means (T), are automatically compensated according to procedures to be described below.

The operation of the apparatus is as follows.

Figure 3:
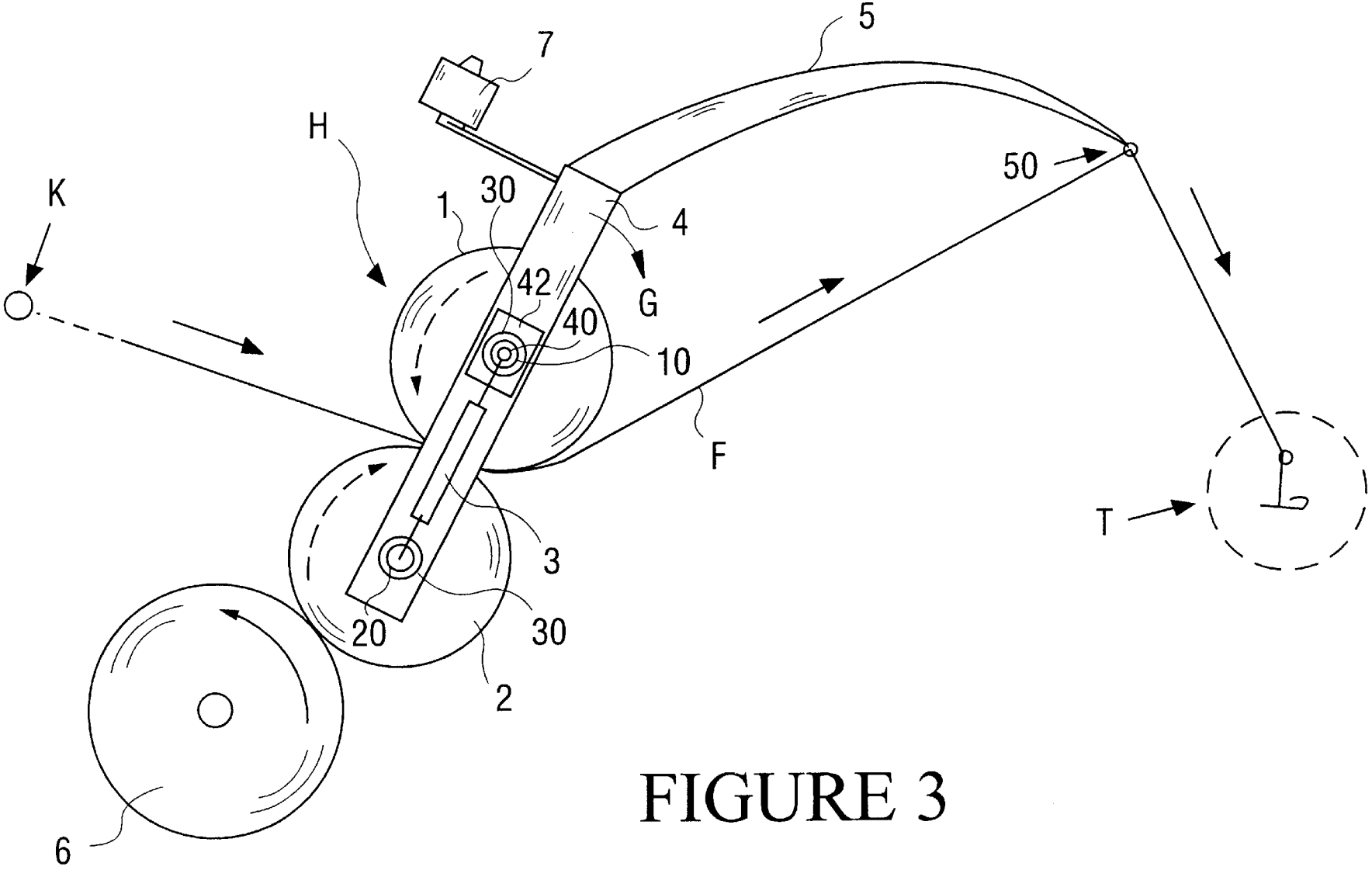
FIG. 3 shows schematically a side view of the apparatus of FIG. 1 in operative condition.
Figure 4:
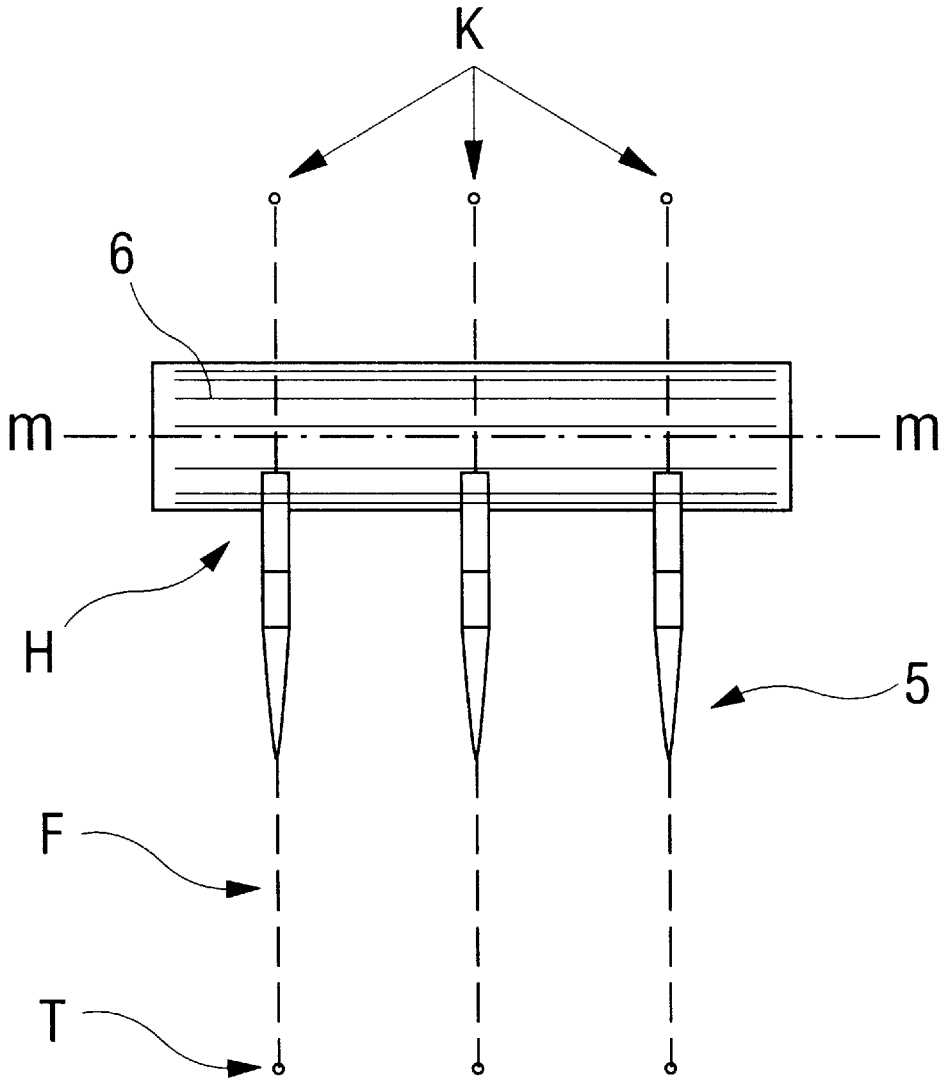
FIG. 4 shows schematically a plan view of an assembly of apparatuses of a type illustrated in the preceding figures.

Upon the activation of the weaving means (T) of the machine, the thread (F) is made to move to the region downstream the calander (H), because of the pull exerted thereon by the same weaving means (T), by following the path indicated by the arrows in FIG. 1, until the vertical component of the force thus exerted on the thread guide 50 causes firstly the bending of arm 5 and, as the pull increases, the subsequent rotation of the body 4 about the respective axis of rotation (s—s) (see arrow G in FIG. 3). Upon the rotation, a contact takes place between the wheel 2 and the roller 6, so that the rotary motion of the latter is transmitted to the wheel 2 and, from this to the first wheel 1. This causes tension of thread (F) upstream of the apparatus, according to the machine's requirement. In case the thread feeding speed, as determined by the roller 6, results higher than the feeding speed required by the corresponding weaving means (T) downstream of the calander (H), the intensity of the force exerted on the thread guiding ring 50 is reduced correspondingly. This causes firstly the elastic lift of arm 5 and, successively, the rotation of body 4 towards the initial inoperative position, which is cause for the breaking off of the contact between the wheel 2 and roller 6.

In this way, there is obtained, de facto, the isolation of the length of thread (F) downstream of the calander (H) from the corresponding length located upstream, so that the latter may be of any extent or be subjected to more or less important friction phenomena, without this affecting the tension of the thread delivered by the weaving means.

The sensitivity of the apparatus may be adjusted by varying the nature of the selected material for the arm 5, in order to achieve different characteristics of elasticity and/or flexibility thereof, as well as varying the distance between the roller 6 and the second wheel 2 or applying weights 7 for balancing the body 4.

Figure 2:
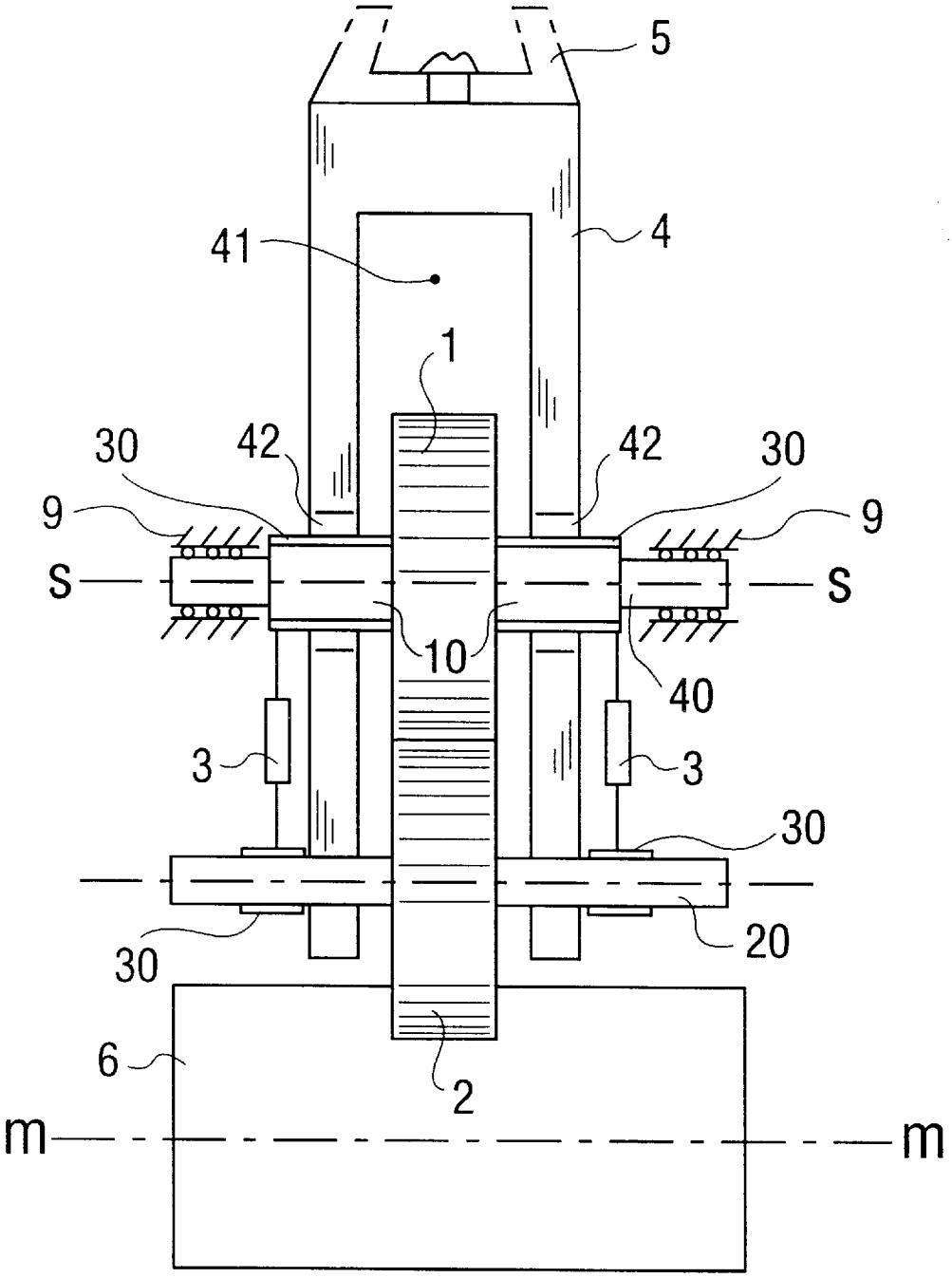
FIG. 2 shows schematically a section view taken on line II—II in FIG. 1.
Figure 5:
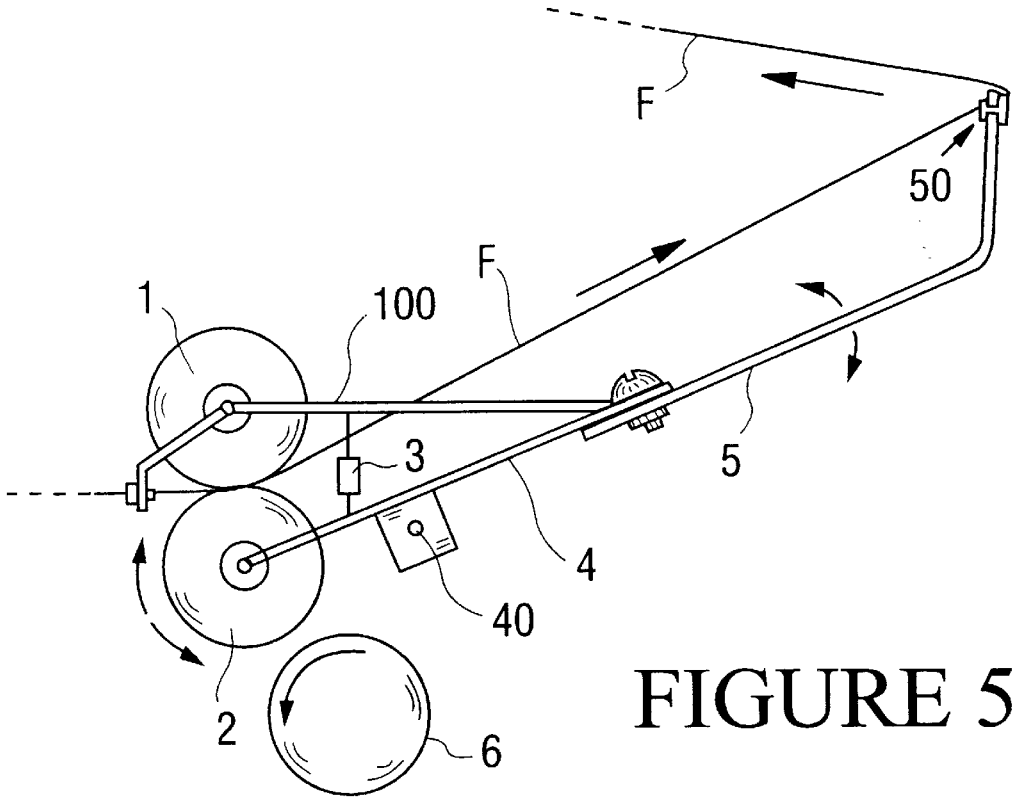
FIG. 5 shows schematically a side view of an apparatus according to a further embodiment of the invention.
Figure 6:
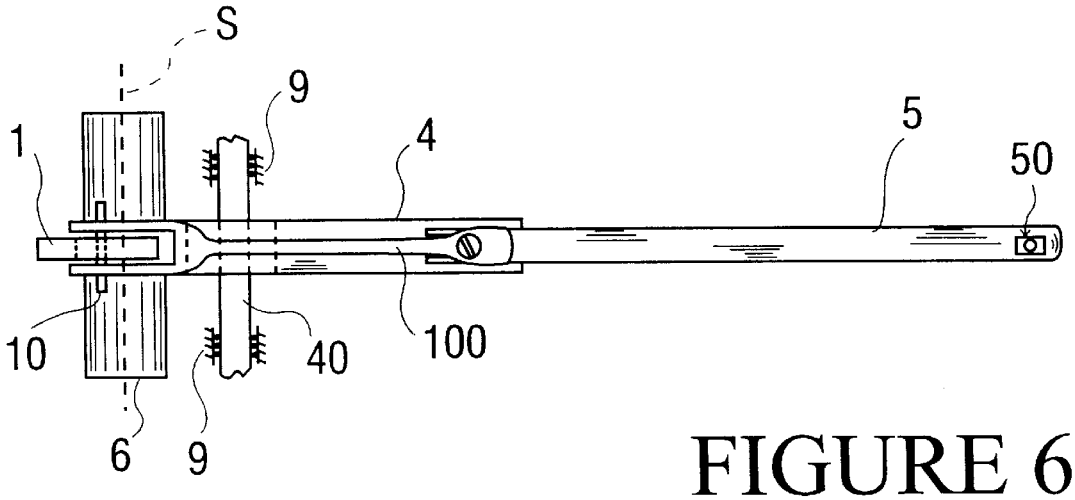
FIG. 6 shows schematically a plan view of the apparatus of FIG. 5.

According to a further embodiment, the body 4 is rotatively mounted on a corresponding body shaft 40 having axis parallel but non coincident with that of the wheel 1 and supported by a spatially fixed, bearing structure 9 by varying the position of the body shaft 40 it is possible to adjust the sensitivity of the apparatus. In particular, reference being made to FIGS. 5 and 6 of the attached drawings, and according to the further embodiment, the body 4 is made up of a lamina of music wire steel to one end of which the shaft 20 of the lower or second wheel 2 is connected, the thread-holder arm 5 being fixed to the opposite end, the body 4 being rotatively mounted on the respective shaft 40 whose axis is parallel, but non coincident, with the shaft of rotation of the upper or first wheel 1: the shaft 10 of the upper or first wheel 1 of the calander (H) being supported by a rigid body extension element 100 fixed, by riveting for example, to the lower side of the lamina making up the body 4. The very elasticity of the lamina forms an elastic means allowing a steady adherence of the wheels 1, 2 to each other, whatever the diameter of the thread (F), and also in presence of knots or other irregularities in the thread (F). An elastic means 3 such as in FIGS. 1–3 can also be used. The roller 6 is in any case so positioned as to result in contact with the lower or second wheel 2 in order to rotate the lower wheel, by friction, when the body 4 is driven into rotation about the axis of the relevant support shaft 40 by virtue of the greater pull exerted on the thread (F) by the weaving means (T). For example, as shown in FIG. 5 of the attached drawings, the roller 6 is positioned below and forwards with respect to the second wheel 2. The operation of the apparatus according to the further embodiment corresponding to that previously described with reference to the first embodiment.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. In combination:

a thread;

a textile machine;

an apparatus for feeding and tensioning the thread in the textile machine, the apparatus comprising:

a body rotatable about a body axis, said body being formed of a lamina of music wire steel, said body having first and second opposite body ends;

a rigid body extension element attached to said body;

a calander including a first wheel rotatably positioned in said body extension element and a second wheel rotatably positioned at said first body end, said first and second wheels being positionable on opposite sides of the thread, said first and second wheels having respective axes of rotation parallel to each other and parallel to said body axis, said respective axis of said first wheel being non coincident with said body axis;

a thread-holder arm having a first end fixed to said second body end, said thread-holder arm having a second end with a thread-guiding ring, said second end of said thread-holder arm being positioned with respect to said body axis and the textile machine to cause rotation of said body about said body axis when a tension of the thread from the textile machine is greater than a predetermined value, said thread-holder arm being formed of flexible and elastic material;

acceleration means for accelerating said second wheel by frictional engagement when said tension of the thread is higher than said predetermined value.

2. A combination in accordance with claim 1, wherein:

said acceleration means includes a roller rotating about a roller axis parallel to said respective axis of said second wheel, said roller being positioned for frictional engagement with said second wheel when said body is rotated due to said tension in the thread.

3. A combination in accordance with claim 2, wherein:

said roller is operated by an electric motor.

4. A combination in accordance with claim 1, further comprising:

elastic means for biasing said first and second wheels toward each other.

5. A combination in accordance with claim 1, wherein:

said thread-holder arm is formed from one of music wire steel and artificial plastic material.

6. In combination:

a thread;

a textile machine;

an apparatus for feeding and tensioning the thread in the textile machine, the apparatus comprising:

a body rotatable about a body axis, said body having first and second opposite body ends;

a rigid body extension element attached to said body;

a calander including a first wheel rotatably positioned in said body extension element and a second wheel rotatably positioned at said first body end, said first and second wheels being positionable on opposite sides of the thread, said first and second wheels having respective axes of rotation parallel to each other and parallel to said body axis, said respective axis of said first wheel being spaced from said body axis;

a thread-holder arm having a first end fixed to said second body end, said thread-holder arm having a second end with a thread-guiding ring, said second end of said thread-holder arm being positioned with respect to said body axis and the textile machine to cause rotation of said body about said body axis when a tension of the thread from the textile machine is greater than a predetermined value;

acceleration means for accelerating said second wheel by frictional engagement when said tension of the thread is higher than said predetermined value.

* * * * *